US009622014B2

(12) United States Patent
Chabanne et al.

(10) Patent No.: US 9,622,014 B2
(45) Date of Patent: Apr. 11, 2017

(54) RENDERING AND PLAYBACK OF SPATIAL AUDIO USING CHANNEL-BASED AUDIO SYSTEMS

(71) Applicant: Dolby Laboratories Licensing Corporation, San Francisco, CA (US)

(72) Inventors: Christophe Chabanne, Carpentras (FR); Brett Crockett, Brisbane, CA (US); Spencer Hooks, San Mateo, CA (US); Alan Seefeldt, San Francisco, CA (US); Nicolas R. Tsingos, Palo Alto, CA (US); Mark Tuffy, Sonoma, CA (US); Rhonda Wilson, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 68 days.

(21) Appl. No.: 14/409,440

(22) PCT Filed: Jun. 17, 2013

(86) PCT No.: PCT/US2013/046184
§ 371 (c)(1),
(2) Date: Dec. 18, 2014

(87) PCT Pub. No.: WO2013/192111
PCT Pub. Date: Dec. 27, 2013

(65) Prior Publication Data

US 2015/0146873 A1 May 28, 2015

Related U.S. Application Data

(60) Provisional application No. 61/661,739, filed on Jun. 19, 2012.

(51) Int. Cl.
*H04S 7/00* (2006.01)
*H04S 3/00* (2006.01)

(52) U.S. Cl.
CPC ..... *H04S 7/305* (2013.01); *H04S 3/008* (2013.01); *H04S 2400/03* (2013.01); *H04S 2420/03* (2013.01)

(58) Field of Classification Search
None
See application file for complete search history.

(56) References Cited

U.S. PATENT DOCUMENTS 6,611,212 B1 8/2003 Craven
7,903,824 B2 3/2011 Faller
(Continued)

FOREIGN PATENT DOCUMENTS

RS 1332 U 8/2013
WO 2010/006719 1/2010
WO 2012/025580 3/2012

OTHER PUBLICATIONS

E. N. G. Verheijen, "Sound Reproduction by Wave Field Synthesis", 1997, Delft University of Technology, p. 107-108.*
(Continued)

*Primary Examiner* — Curtis Kuntz
*Assistant Examiner* — Kenny Truong

(57) ABSTRACT

Embodiments are described for a method and system of rendering and playing back spatial audio content using a channel-based format. Spatial audio content that is played back through legacy channel-based equipment is transformed into the appropriate channel-based format resulting in the loss of certain positional information within the audio objects and positional metadata comprising the spatial audio content. To retain this information for use in spatial audio equipment even after the audio content is rendered as channel-based audio, certain metadata generated by the spatial audio processor is incorporated into the channel-based data. The channel-based audio can then be sent to a channel-based audio decoder or a spatial audio decoder. The
(Continued)

spatial audio decoder processes the metadata to recover at least some positional information that was lost during the down-mix operation by upmixing the channel-based audio content back to the spatial audio content for optimal playback in a spatial audio environment.

19 Claims, 8 Drawing Sheets

(56) References Cited

U.S. PATENT DOCUMENTS

| | | | | |
|---|---|---|---|---|
| 8,687,829 | B2 | 4/2014 | Engdegard | |
| 2004/0247134 | A1* | 12/2004 | Miller, III | H04S 3/002 381/19 |
| 2005/0157883 | A1 | 7/2005 | Herre | |
| 2006/0106620 | A1 | 5/2006 | Thompson | |
| 2008/0192965 | A1 | 8/2008 | Strauss | |
| 2009/0164221 | A1 | 6/2009 | Kim | |
| 2010/0014692 | A1 | 1/2010 | Schreiner | |
| 2010/0114582 | A1 | 5/2010 | Beack | |
| 2010/0166191 | A1* | 7/2010 | Herre | |
| 2011/0022402 | A1 | 1/2011 | Engdegard | |
| 2011/0040395 | A1 | 2/2011 | Kraemer | |
| 2011/0200197 | A1 | 8/2011 | Kim | |
| 2011/0305344 | A1 | 12/2011 | Sole | |
| 2012/0002818 | A1* | 1/2012 | Heiko | G10L 19/008 381/22 |
| 2012/0308015 | A1* | 12/2012 | Ramteke | H04S 3/02 381/17 |
| 2014/0119581 | A1* | 5/2014 | Tsingos | H04S 3/008 381/300 |
| 2014/0133683 | A1* | 5/2014 | Robinson | H04S 3/008 381/303 |

OTHER PUBLICATIONS

Goodwin, M.M. et al. "Multichannel Matching Pursuit and Applications to Spatial Audio Coding" IEEE Fortieth Asilomar Conference on Signals, Systems and Computers, Oct. 29, 2006-Nov. 1, 2006, pp. 1114-1118.

Herre, J. et al "Spatial Audio Coding: Next-Generation Efficient and Compatible Coding of Multi-Channel Audio" AES presented at the 117th Convention, Oct. 28-31, 2004, San Francisco, CA, USA.

Engdegard, J. et al "Spatial Audio Object Coding (SAOC)—The Upcoming MPEG Standard on Parametric Object Based Audio Coding" AES presented at the 124th Convention May 17-20, 2008, Amsterdam, The Netherlands.

Stanojevic, T. et al "The Total Surround Sound System", 86th AES Convention, Hamburg, Mar. 7-10, 1989.

Stanojevic, T. et al "Designing of TSS Halls" 13th International Congress on Acoustics, Yugoslavia, 1989.

Stanojevic, T. et al "TSS System and Live Performance Sound" 88th AES Convention, Montreux, Mar. 13-16, 1990.

Stanojevic, Tomislav "3-D Sound in Future HDTV Projection Systems" presented at the 132nd SMPTE Technical Conference, Jacob K. Javits Convention Center, New York City, Oct. 13-17, 1990.

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.

Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.

Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.

Stanojevic, T. et al "The Total Surround Sound (TSS) Processor" SMPTE Journal, Nov. 1994.

Stanojevic, Tomislav "Surround Sound for a New Generation of Theaters, Sound and Video Contractor" Dec. 20, 1995.

* cited by examiner

800

| METADATA TYPE | METADATA ELEMENTS |
|---|---|
| INFLECTION POINT | inflection point position |
| HEIGHTS CHANNEL TRAJECTORIES | Trajectories<br>$(x_{LFH}, y_{LFH})$<br>$(x_{RFH}, y_{RFH})$ |
| DIRECT UPMIX | up-mix matrix M |
| DIRECT DOWNMIX | down-mix matrix D<br>flag indicating D is for upmix |

RENDERING AND PLAYBACK OF SPATIAL AUDIO USING CHANNEL-BASED AUDIO SYSTEMS

CROSS-REFERENCE TO RELATED APPLICATIONS

This application claims priority to U.S. Provisional Patent Application No. 61/661,739 filed on 19 Jun. 2012, the contents of which are incorporated herein by reference.

FIELD OF THE INVENTION

One or more implementations relate generally to audio signal processing, and more specifically to processing spatial (object-based) audio content for playback on legacy channel-based audio systems.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Ever since the introduction of sound with film, there has been a steady evolution of technology used to capture the creator's artistic intent for the motion picture sound track and to accurately reproduce it in a cinema environment. A fundamental role of cinema sound is to support the story being shown on screen. Typical cinema sound tracks comprise many different sound elements corresponding to elements and images on the screen, dialog, noises, and sound effects that emanate from different on-screen elements and combine with background music and ambient effects to create the overall audience experience. The artistic intent of the creators and producers represents their desire to have these sounds reproduced in a way that corresponds as closely as possible to what is shown on screen with respect to sound source position, intensity, movement and other similar parameters.

Traditional channel-based audio systems send audio content in the form of speaker feeds to individual speakers in a playback environment, such as stereo and 5.1 systems. The introduction of digital cinema has created new standards for sound on film, such as the incorporation of up to 16 channels of audio to allow for greater creativity for content creators, and a more enveloping and realistic auditory experience for audiences. The introduction of 7.1 surround systems has provided a new format that increases the number of surround channels by splitting the existing left and right surround channels into four zones, thus increasing the scope for sound designers and mixers to control positioning of audio elements in the theatre.

Expanding beyond traditional speaker feeds and channel-based audio as a means for distributing spatial audio is critical, and there has been considerable interest in a model-based audio description which holds the promise of allowing the listener/exhibitor the freedom to select a playback configuration that suits their individual needs or budget, with the audio rendered specifically for their chosen configuration.

To further improve the listener experience, playback of sound in virtual three-dimensional environments has become an area of increased research and development. The spatial presentation of sound utilizes audio objects, which are audio signals with associated parametric source descriptions of apparent source position (e.g., 3D coordinates), apparent source width, and other parameters. Object-based audio is increasingly being used for many current multimedia applications, such as digital movies, video games, simulators, and 3D video and is of particular importance in a home environment where the number of reproduction speakers and their placement is generally limited or constrained.

A next generation spatial audio format may consist of a mixture of audio objects and more traditional channel-based speaker feeds along with positional metadata for the audio objects. In a next generation spatial audio decoder, the channels are sent directly to their associated speakers if the appropriate speakers exist. If the full set of specified speakers does not exist, then the channels may be down-mixed to the existing speaker set. This is similar to existing legacy channel-based decoders. Audio objects are rendered by the decoder in a more flexible manner. The parametric source description associated with each object, such as a positional trajectory in 3D space, is taken as input along with the number and position of speakers connected to the decoder. The renderer then utilizes one or more algorithms, such as a panning law, to distribute the audio associated with each object across the attached set of speakers. This way, the authored spatial intent of each object is optimally presented over the specific speaker configuration.

When content is authored in a next generation spatial audio format, it may still be desirable to send this content in an existing legacy channel-based format so that it may be played on legacy audio systems. This involves downmixing the next generation audio format to the appropriate channel-based format (e.g., 5.1, 7.1, etc.). When generating channel-based downmixes from three-dimensional content, one of the main challenges is to preserve spatial coherence between the original mix and the downmix.

In order to support already deployed audio systems, it is desirable to render a next generation spatial audio format into a legacy channel-based format. However, when rendering spatial audio content into a legacy format, a portion of the original spatial information may be lost. For example, a 7.1 legacy format may contain only a stereo pair of front height channels in the height plane. Since this stereo pair can only convey motion to the left and right, all forward or backward motion of audio objects in the height plane is lost. In addition, any height objects positioned within the room are collapsed to the front, thus resulting in the loss of important creative content. When playing the original spatial audio content in a channel-based system, this loss of information is generally acceptable because of the limitations of the legacy surround sound environment. If, however, the down-mixed spatial audio content is to be played back through a spatial audio system, this lost information will likely cause a degradation of the playback experience.

What is needed, therefore, is a means to recover this lost spatial information when reproducing spatial audio converted to a legacy channel-based format for playback in a spatial audio environment.

BRIEF SUMMARY OF EMBODIMENTS

Systems and methods are described for rendering a next generation spatial audio format into a channel-based format and inserting additional metadata derived from the spatial audio format into the channel-based format which, when combined with the channels in an enhanced decoder, recovers spatial information lost during the channel-based rendering process. Such a method is intended to be used with a next generation cinema sound format and processing system that includes a new speaker layout (channel configuration) and an associated spatial description format. This system utilizes a spatial (or adaptive) audio system and format in which audio streams are transmitted along with metadata that describes the desired position of the audio stream. The position can be expressed as a named channel (from within the predefined channel configuration) or as three-dimensional position information in a format that combines optimum channel-based and model-based audio scene description methods. Audio data for the spatial audio system comprises a number of independent monophonic audio streams, wherein each stream has associated with it metadata that specifies whether the stream is a channel-based or object-based stream. Channel-based streams have rendering information encoded by means of channel name; and the object-based streams have location information encoded through mathematical expressions encoded in further associated metadata.

Spatial audio content that is played back through legacy channel-based equipment is transformed (down-mixed) into the appropriate channel-based format thus resulting in the loss of certain of the positional information within the audio objects and positional metadata comprising the spatial audio content. To retain this information for use in spatial audio equipment even after the audio content is rendered as channel-based audio, certain metadata generated by the spatial audio processor is incorporated into the channel-based data. The channel-based audio can then be sent to a channel-based audio decoder or a spatial audio decoder. The spatial audio decoder processes the metadata to recover at least some of the positional information that was lost during the downmix operation by upmixing the channel-based audio content back to the spatial audio content for optimal playback in a spatial audio environment.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION OF THE INVENTION

Figure 1:
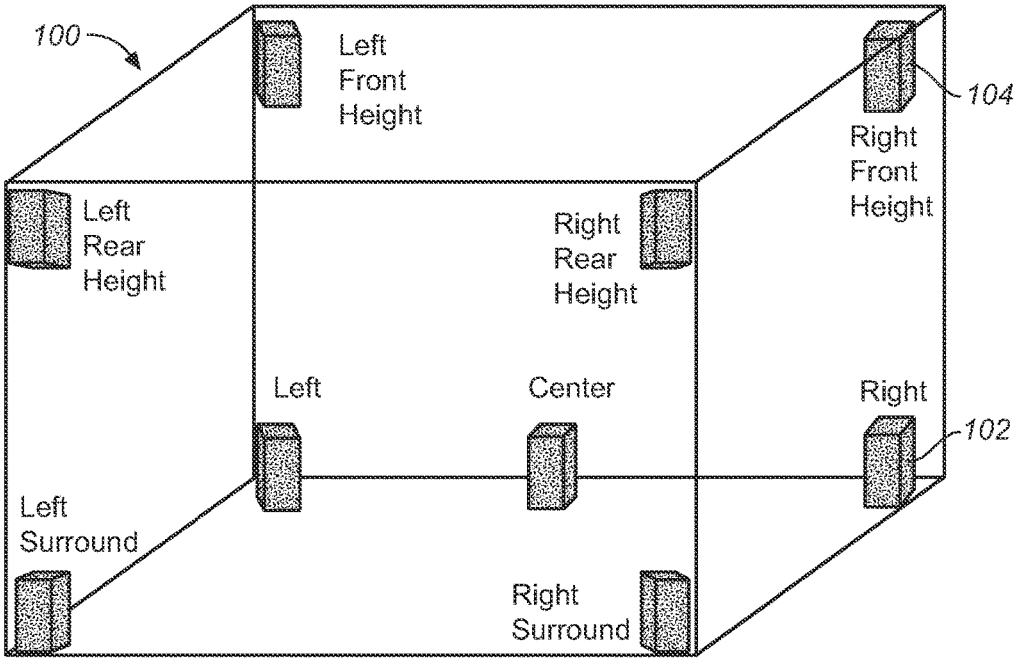
FIG. 1 illustrates the speaker placement in a 9.1 surround system that may be used in embodiments.

Systems and methods are described for an adaptive audio system that supports downmix and up-mix methods utilizing certain metadata for playback of spatial audio content on channel-based legacy systems as well as next generation spatial audio systems. Aspects of the one or more embodiments described herein may be implemented in an audio or audio-visual system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" means a monophonic audio signal or an audio stream plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on (where 5.1 refers to a six-channel surround sound audio system having front left and right channels, center channel, two surround channels, and a subwoofer channel; 7.1 refers to an eight-channel surround system that adds two additional surround channels or two additional height channels to the 5.1 system); the term "object" means one or more audio channels with a parametric source description, such as apparent source position (e.g., 3D coordinates), apparent source width, etc.; and "adaptive audio" means channel-based and/or object-based audio signals plus metadata that renders the audio signals based on the playback environment using an audio stream plus metadata in which the position is coded as a 3D position in space.

Embodiments are directed to a sound format and processing system that may be referred to as an "spatial audio system," "adaptive audio system," or a "next generation" system and that utilizes a new spatial audio description and rendering technology to allow enhanced audience immersion, more artistic control, system flexibility and scalability, and ease of installation and maintenance. Embodiments of such a system for use in a cinema audio platform include several discrete components including mixing tools, packer/encoder, unpack/decoder, in-theater final mix and rendering components, new speaker designs, and networked amplifiers. An example of such an adaptive audio system that may be used in conjunction with present embodiments is described in International Patent Publication No. WO2013/006338 published 10 Jan. 2013, which is hereby incorporated by reference.

An example of an implemented next generation system and associated audio format is the Dolby® Atmos™ platform. Such a system incorporates a height (up/down) dimension that may be implemented as a 9.1 surround system. FIG. 1 illustrates the speaker placement in a 9.1 surround system that may be used in some embodiments. The speaker configuration of the 9.1 system 100 is composed of five speakers 102 in the floor plane and four speakers 104 in the height plane. In general, these speakers can represent any position more or less accurately within the room. Legacy systems (e.g., Blu Ray, HDMI, AVRs, etc.), however, are almost always limited to 7.1 channels. For playback in legacy consumer 7.1 systems, the height plane of the 9.1 system must be represented by only two speakers, thereby introducing potentially significant spatial position errors for content that is produced for the 9.1 system. This means that beyond the core 5.1 speakers, only two speakers remain to represent the original three-dimensional mix. Up until now, mixes only leveraged two dimensions (left-right and front-back), which meant that these additional two speakers were always added to the floor plane, increasing the representational accuracy within the same two dimensions, at the expense of the third dimension.

Prioritizing Dimensions

Predefined speaker configurations can naturally limit the ability to represent the position of a given sound source; as a simple example, a sound source cannot be panned further left than the left speaker itself. This applies to every speaker, therefore forming a one-dimensional (e.g., left-right), two-dimensional (e.g., front-back), or three-dimensional (e.g., left-right, front-back, up-down) geometric shape, in which the downmix is constrained.

Figure 2:
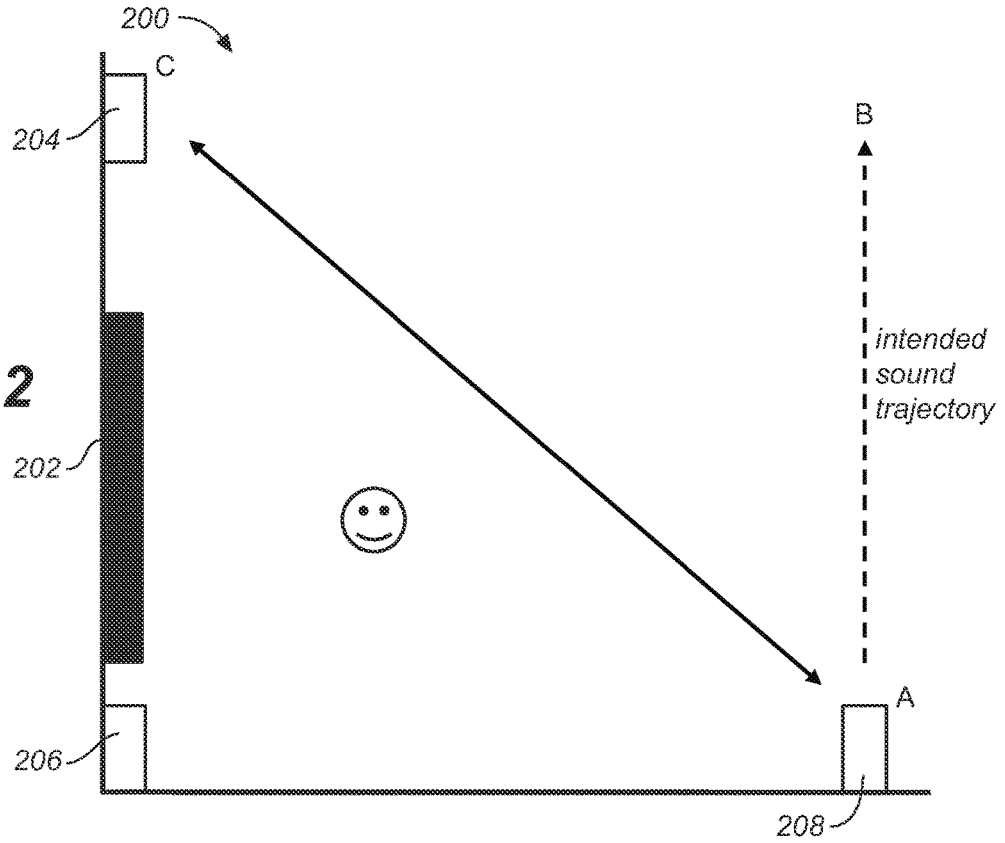
FIG. 2 illustrates the reproduction of 9.1 channel sound in a 7.1 system, under an embodiment.

FIG. 2 illustrates the reproduction of 9.1 channel sound in a 7.1 system, in accordance with an embodiment. Diagram 200 of FIG. 2 shows the side view of a 7.1 height configuration in a cinema environment in which a screen 202 is placed on a front wall of a cinema relative to an array of speakers 204-208. The height channel 204 is located directly above the floor left and floor right channels 206 on or proximate the front wall. Speakers 208 on the floor provide the rear surround channels. As can be seen in FIG. 2, in a standard 7.1 system, an intended trajectory of sound, from point A to point B over the head of the audience is impossible to properly represent since there is no speaker located at point B in the 7.1 system. Instead, the sound is played back through the surround speaker(s) 208 on the floor of the cinema. Embodiments include a method of downmixing the 9.1 to 7.1 sound content using a dimension prioritization technique, such that the sound trajectory is more accurately represented.

In an embodiment, the downmix method used to represent the intended sound trajectory (e.g., the A to B trajectory in FIG. 2) in a 7.1 height configuration involves prioritizing the up/down dimension over the front-back dimension. In this case, maintaining the sound source's vertical movement would be considered more important than maintaining its rear surround position. The resulting trajectory is from A to C, which introduces an error on the front-back dimension, but preserves the sense of elevation of the sound.

The other option is to prioritize the front-back (horizontal) dimension instead of the vertical dimension, and thereby prevent the sound source from moving forward. In this case, the sound is emanated from point A only. The sound source thus remains where it should be on the front-back dimension, but loses its height dimension.

Figure 3:
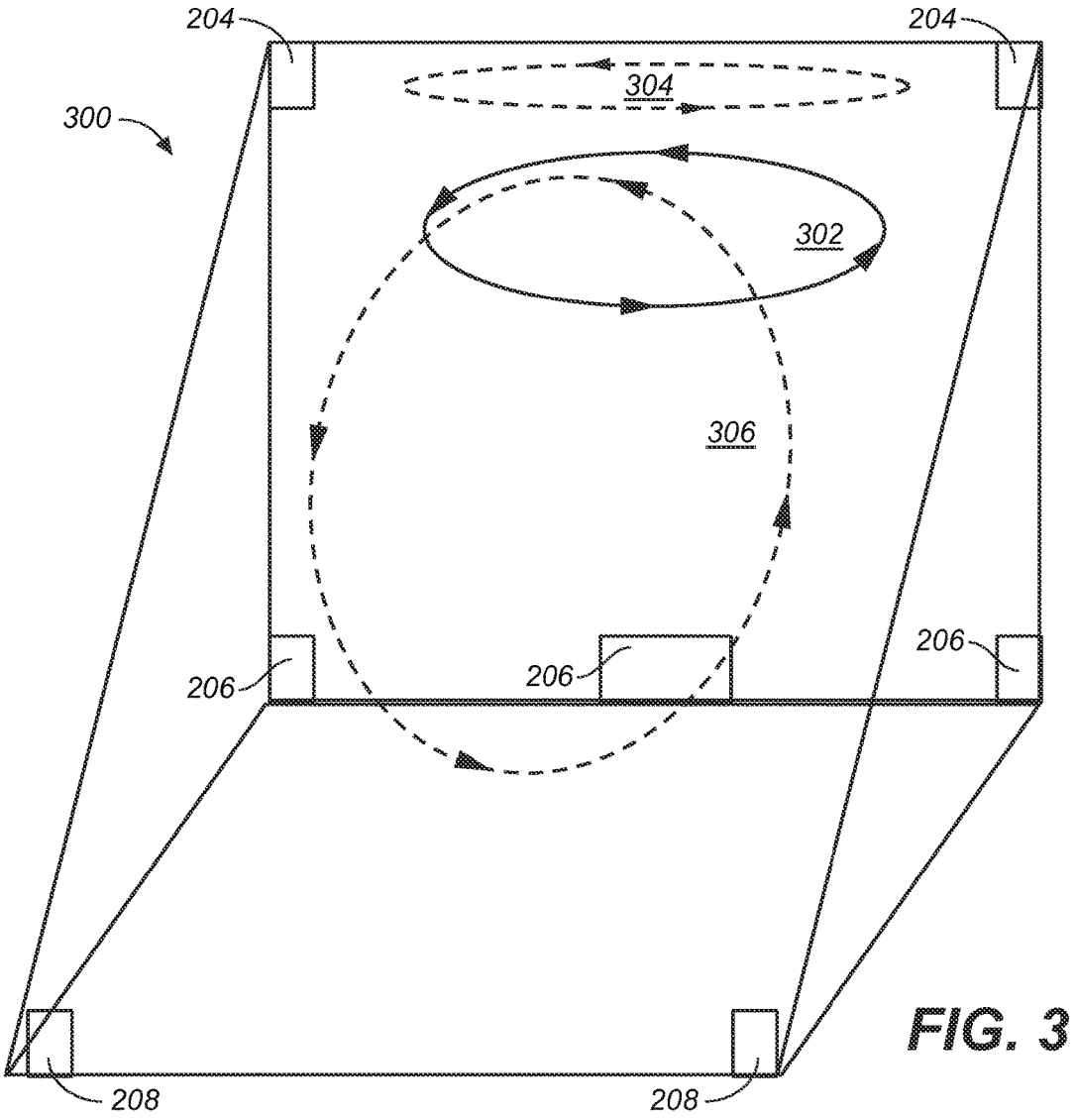
FIG. 3 illustrates a technique of prioritizing dimensions for rendering 9.1 channel sound in a 7.1 system along an audio plane, under an embodiment.

Applying the same prioritization concept to a height-only trajectory, such as a helicopter hovering above the listener, would result in the sound source either moving along the diagonal plane formed by Lh/Rh/Ls/Rs, or remaining locked between Lh and Rh. FIG. 3 illustrates a technique of prioritizing dimensions for rendering 9.1 channel sound in a 7.1 system along an audio plane, under an embodiment. As shown in FIG. 3, the front wall of the cinema has front speakers 206 and height speakers 204, while the rear wall has surround speakers 208, thus illustrating a perspective view of the cinema system illustrated in FIG. 2. The intended trajectory of an object shown on the screen (e.g., a helicopter) is shown by path 302, which is intended to sound like the object hovering or flying in a circle above the heads of the audience. If the 7.1 system is configured to emphasize the up-down (vertical) priority, the sound will be reproduced using the height speakers 204, and result in the sound being played back as path 304. Conversely, if the system is configured to emphasize the front-back (horizontal) priority, the sound will be reproduced using the surround speakers 208, and result in the sound being played back as path 306.

While the errors introduced by each of these prioritization methods might be generally acceptable, combining the human ear's lower perceptual accuracy for sources located behind the listener and visual cues provided by the screen as to where the sound source should be, makes prioritizing the front-back dimension a generally better choice if only one dimension can be prioritized over the other one.

Rendering Mismatch and Inflection Points

Figure 4A:
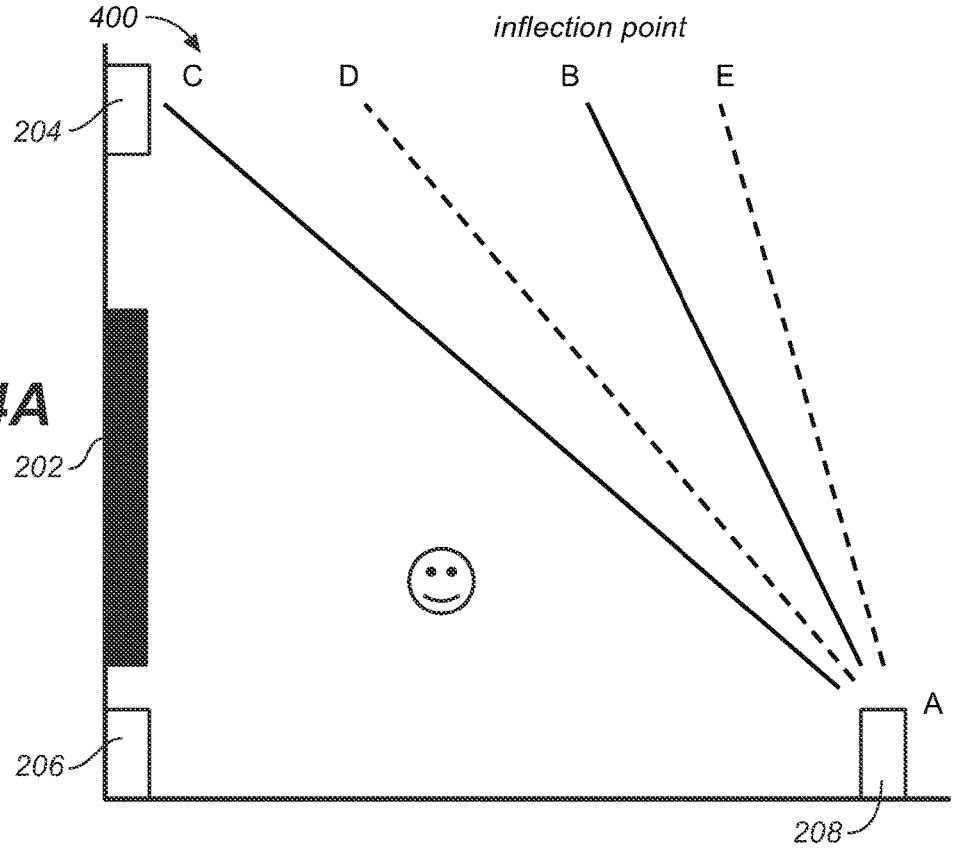
FIG. 4A illustrates the use of an inflection point to facilitate downmixing of audio content from a 9.1 mix to a 7.1 mix, under an embodiment.

When downmixing a three-dimensional mix to the 7.1 speaker configuration FIG. 3, it may be beneficial to purposefully mismatch the rendering algorithm and the targeted downmix configurations. For example, if the original mixing stage had height speakers located above the listener (such as commonly used in cinema), as opposed to above the home theater front left and front right height channels, very little energy would be perceived by the listener as coming from the front height channels. Most of the time, the elevated sound sources would be perceived by the listener as concentrating in the middle of the room, blending across all three dimensions, and making them difficult to localize. In order to avoid this problem, an embodiment of the system implements an inflection point on the front-height to surround pan. FIG. 4A illustrates the use of an inflection point to facilitate downmixing of audio content from a 9.1 mix to a 7.1 mix, under an embodiment. As shown in system 400, the renderer would assume that a speaker is present at for example position B, but the signal derived for B would be played back out of position at location C. Doing so maintains height sound elements strictly in the height speakers 204, until they have passed the inflection point (position B) on the front-back dimension, at which point the pan between the front height and the surround speakers begins, lowering height elements towards the floor surround speaker. Thus, for example, as shown in FIG. 4A, sounds that pass in front of the inflection point B virtually emanate from position D, and sounds that pass behind the inflection point B virtually emanate from position E.

This solution allows prioritizing the up-down dimension from the front of the room to the inflection point (to maximize height energy and discreetness), and the front-back dimension from the inflection point to the back of the room (to maximize spatial coherence).

Figure 4B:
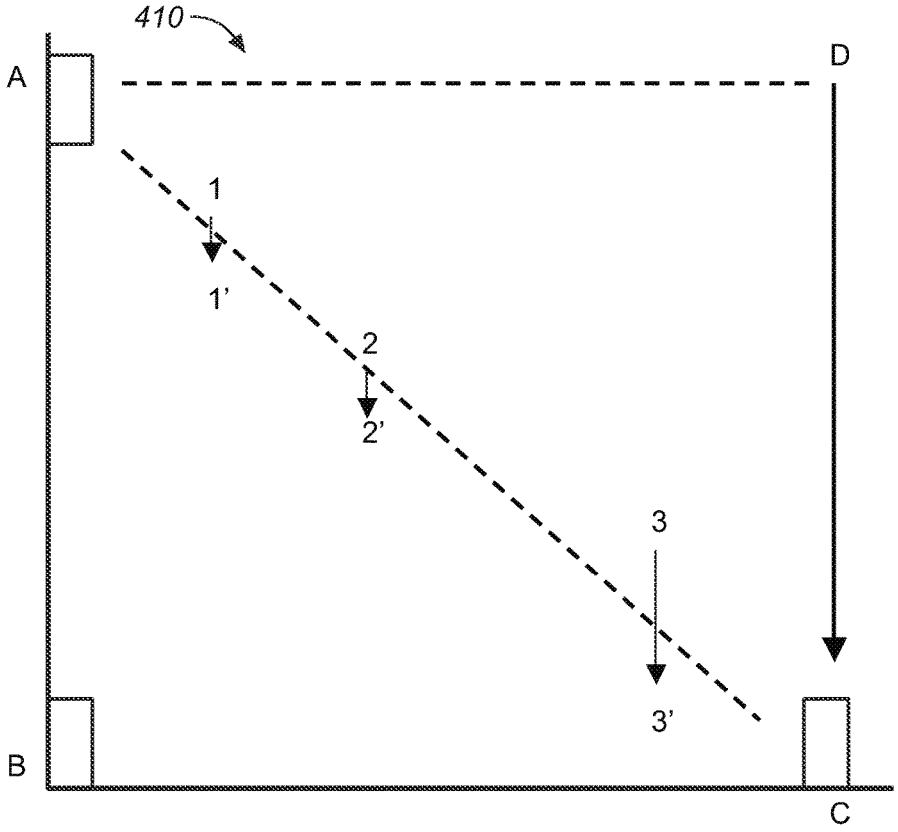
FIG. 4B illustrates a distortion due to using front floor speakers to reproduce spatial audio, in an example implementation.

While this method generally provides some benefit, it may also exhibit the drawback of forcing the use of the front floor speakers for any sound located below the original front-height to back-height axis, such shown as axis point A to point D in FIG. 4B. FIG. 4B illustrates a distortion due to using front floor speakers to reproduce spatial audio, in an example implementation. With reference to diagram 410 of FIG. 4B, collapsing point C and D distorts the rectangle ABCD into a triangle ABC. Thus, what is the middle of the rectangle, at point 2, becomes the middle of the triangle, point 2'. The same distortion occurs proportionally at other points, as shown by the shift from point 1 to point 1', and from point 3 to point 3', for example.

Figure 4C:
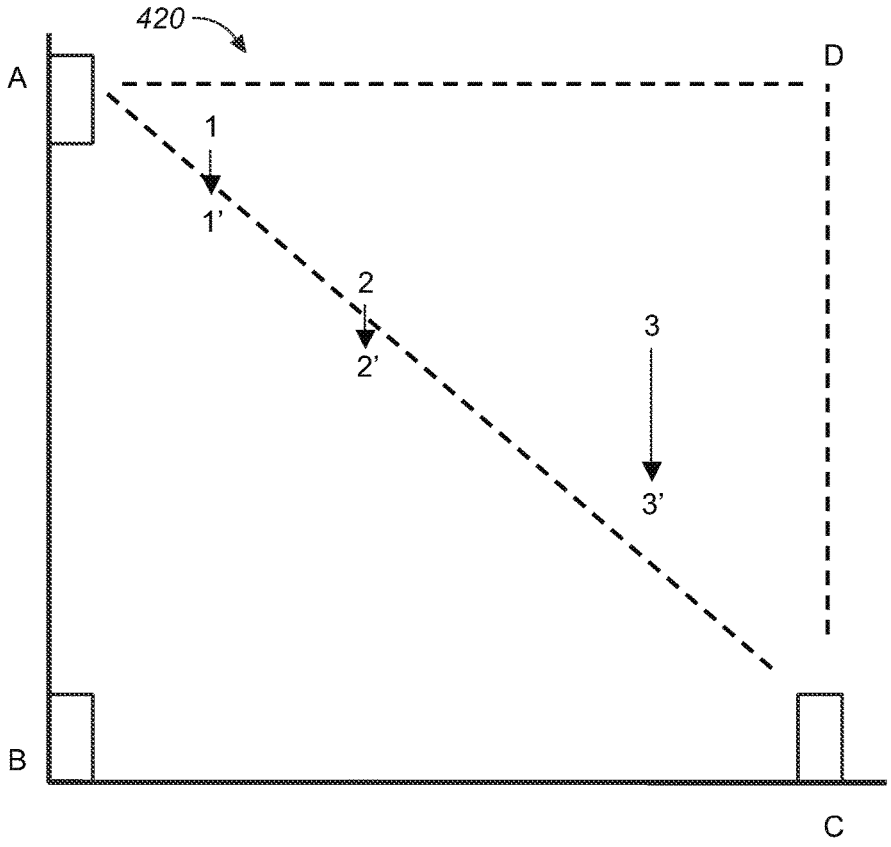
FIG. 4C represents a situation in which points located above the diagonal axis, get placed onto the diagonal axis, for the example implementation of FIG. 4B.

Because the most height that can be represented in a 7.1 height configuration is along the diagonal from A to C, any point located above this diagonal should be pulled down onto the diagonal, and not below it. FIG. 4C represents a situation in which points located above the diagonal axis, get placed onto the diagonal axis, for the example implementation of FIG. 4B. As shown in diagram 420, this effect basically "clips" the up/down dimension of objects 1, 2, and 3 to the axis A-C.

While prioritizing dimensions using inflection points and/or clipping the up/down dimension can provide a great downmixing solution for legacy playback, much of the original spatial information of the next generation format may be lost in this process; it is therefore desirable to provide a means for recovering at least some of this lost information.

Spatial Audio System

Figure 5:
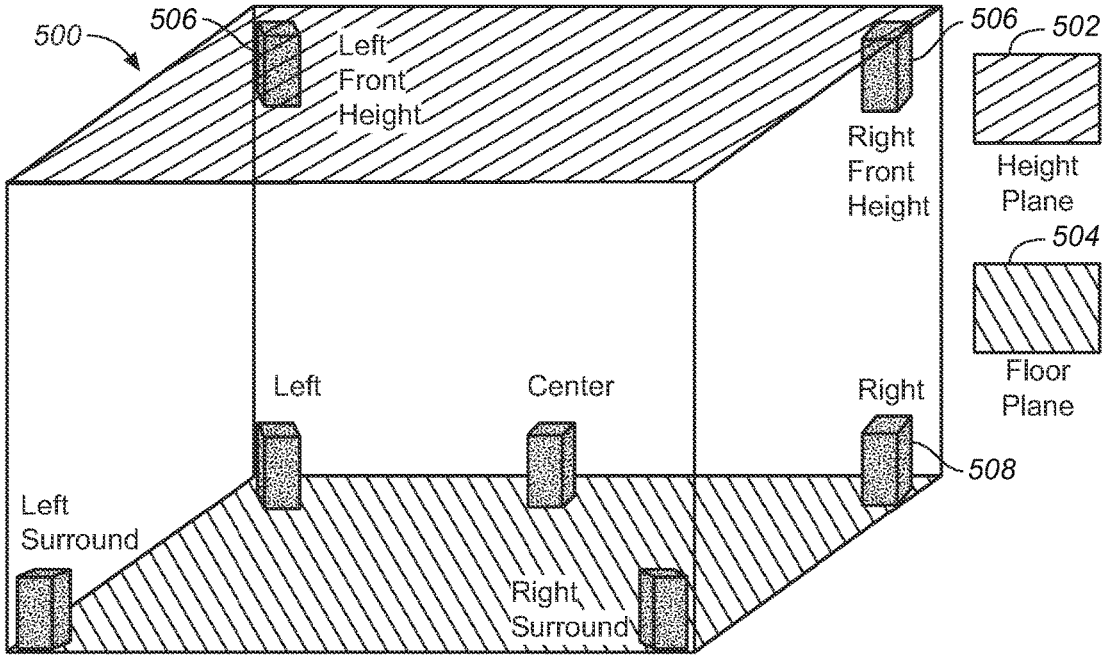
FIG. 5 illustrates a channel layout for a 7.1 surround system for use in conjunction with embodiments of a downmix system for spatial or adaptive audio content.
Figure 6A:
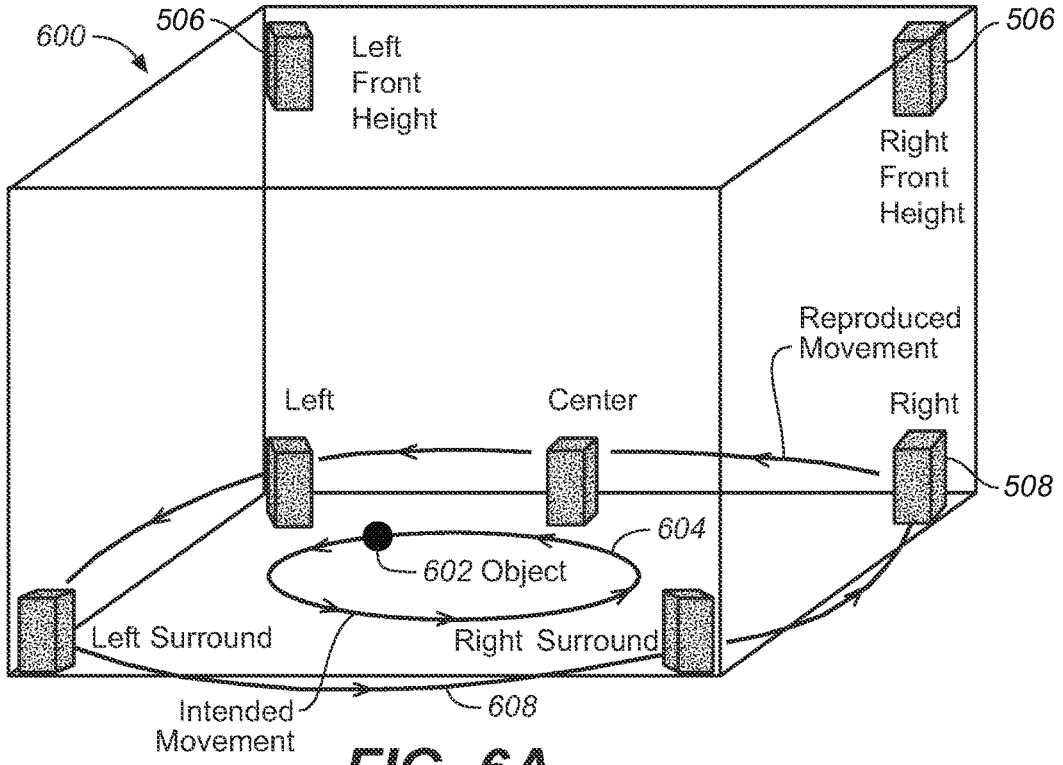
FIG. 6A illustrates the reproduction of position and motion of audio objects in the floor plane, in an example embodiment.

Embodiments are directed to a system in which next generation spatial audio format is rendered into a 7.1 legacy channel-based format containing five channels in the floor plane (Left, Center, Right, Left Surround, Right Surround) and two channels in the height plane (Left Front Height, Right Front Height). FIG. 5 illustrates a channel layout for a 7.1 surround system for use in conjunction with embodiments of a processing system for spatial or adaptive audio content. In general, the five channels 508 in the floor plane 504 are sufficient to accurately convey the intended position and motion of audio objects in the floor plane. FIG. 6A illustrates the reproduction of position and motion of audio objects in the floor plane, in an example embodiment. As shown in diagram 600, an object 602 is intended to sound as if it is moving in a circular path 604 along the floor of the cinema (or other listening environment). Through the position of the floor plane speakers 508, the actual reproduced sound is along path 608.

Figure 6B:
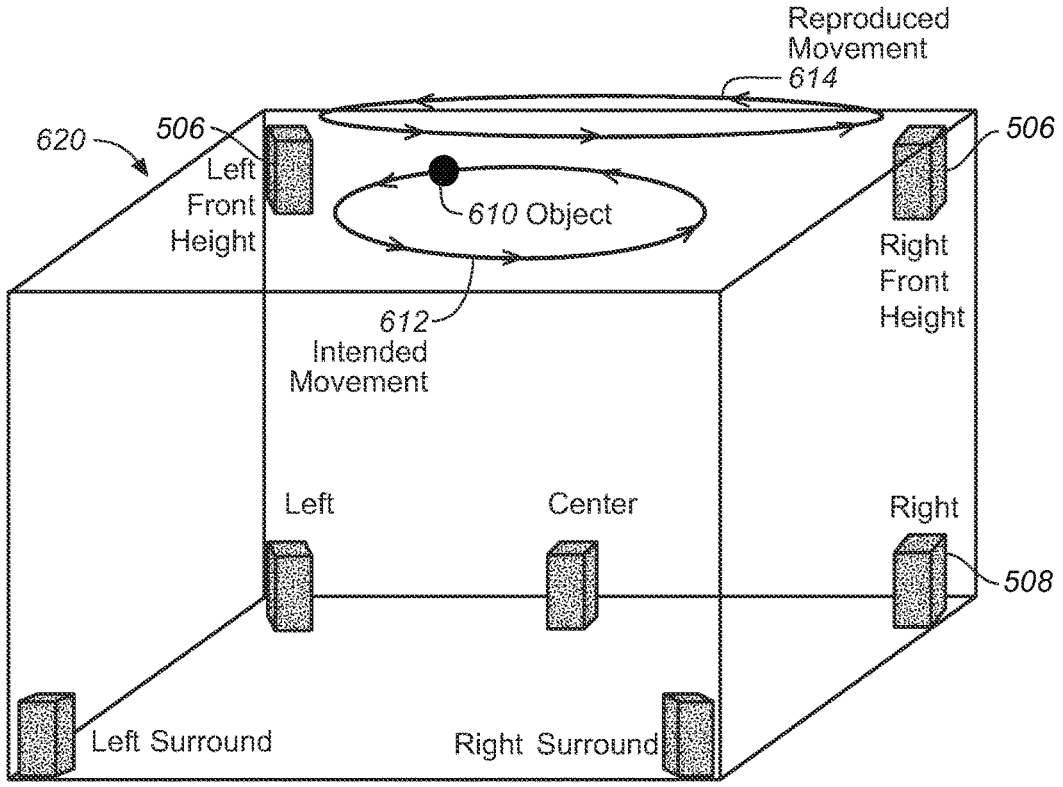
FIG. 6B illustrates the reproduction of position and motion of audio objects in the height plane in an example embodiment.

For the floor plane case, the relative trajectory of the sound path is retained due to the availability and orientation of the floor speakers 508. However, in the height plane 502, the position and motion of objects is collapsed into the two front height channels 506 only, potentially altering the original intent of those objects. FIG. 6B illustrates the reproduction of position and motion of audio objects in the height plane in an example embodiment. As shown in diagram 620, an object 610 is intended to sound as if it is moving in a circular path 604 along the ceiling of the cinema. Since this sound can be reproduced only through the front height speakers 506, the actual reproduced sound is along path 610, which compresses the sound toward the front wall. For listeners located toward the back of the cinema, the sound thus seems to originate from the front of the room, rather than directly overhead.

In some embodiments, the system includes components that generate metadata from the original spatial audio format, which when combined with these two front height channels 508 in an enhanced decoder, allows the lost spatial information in the height plane to be approximately recovered.

Figure 7A:
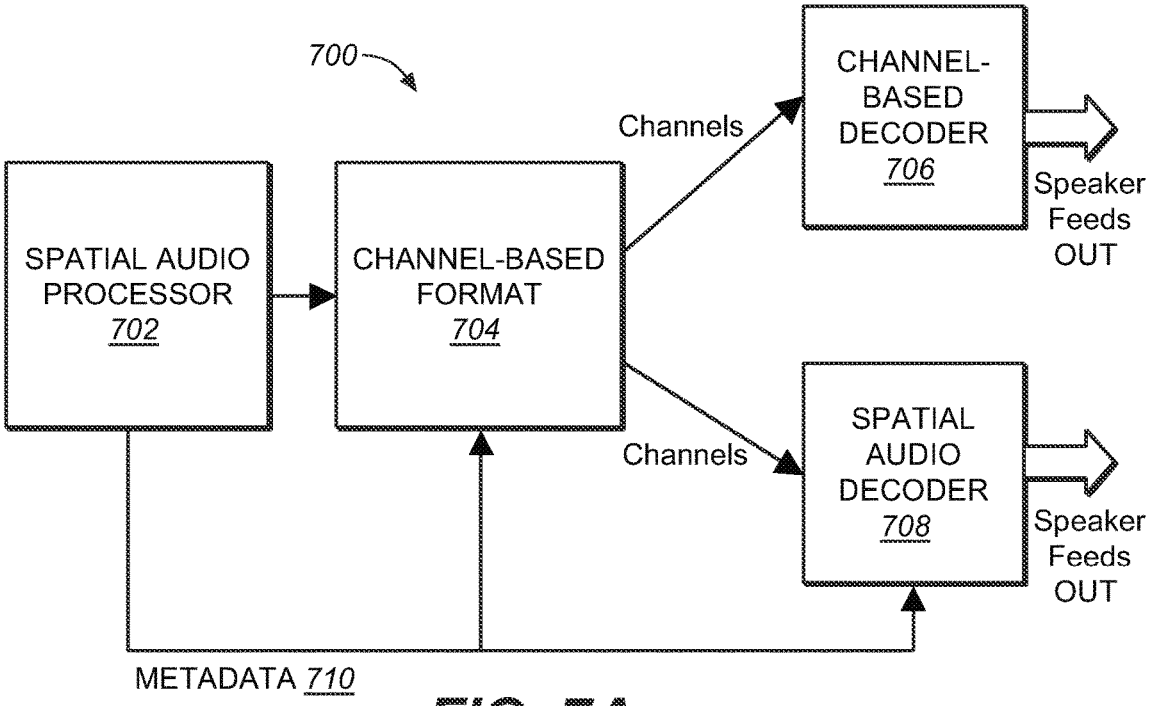
FIG. 7A is a block diagram of a system that implements a spatial audio to channel-based audio downmix method, under an embodiment.

FIG. 7A is a block diagram of a system that implements a spatial audio to channel-based audio downmix method, in accordance with some embodiments. The system 700 of FIG. 7A represents a portion of an audio creation and playback environment utilizing an adaptive audio system, such as described in International Patent Publication No. WO2013/006338, published 10 Jan. 2013. In an embodiment, the methods and components of system 700 comprise an audio encoding, distribution, and decoding system configured to generate one or more bitstreams containing both conventional channel-based audio elements and audio object coding elements. Such a combined approach provides greater coding efficiency and rendering flexibility compared to either channel-based or object-based approaches taken separately. The spatial audio processor 702 includes means to configure a predefined channel-based audio codec to include audio object coding elements. A new extension layer containing the audio object coding elements is defined and added to the base or backwards-compatible layer of the channel-based audio codec bitstream. This approach enables bitstreams, which include the extension layer to be processed by legacy decoders, while providing an enhanced listener experience for users with new generation decoders.

In an embodiment, authoring tools allow for the ability to create speaker channels and speaker channel groups. This allows metadata to be associated with each speaker channel group. Each speaker channel group may be assigned unique instructions on how to up-mix from one channel configuration to another, where upmixing is defined as the creation of M audio channels from N channels where M>N. Each speaker channel group may be also be assigned unique instructions on how to downmix from one channel configuration to another, where downmixing is defined as the creation of Y audio channels from X channels where Y<X.

The spatial audio content from spatial audio processor 702 comprises audio objects, channels, and position metadata. When an object is rendered, it is assigned to one or more speakers according to the position metadata, and the location of the playback speakers. Additional metadata may be associated with the object to alter the playback location or otherwise limit the speakers that are to be used for playback. In general, the spatial audio capabilities are realized by enabling a sound engineer to express his or her intent with regard to the rendering and playback of audio content through an audio workstation. By controlling certain input controls, the engineer is able to specify where and how audio objects and sound elements are played back depending on the listening environment. Metadata is generated in the audio workstation in response to the engineer's mixing inputs to provide rendering queues that control spatial parameters (e.g., position, velocity, intensity, timbre, etc.) and specify which speaker(s) or speaker groups in the listening environment play respective sounds during exhibition. The metadata is associated with the respective audio data in the workstation for packaging and transport by spatial audio processor.

With reference to FIG. 7A, the spatial audio processor 702 generates channel and channel-based audio and audio object coding information in accordance with spatial audio definitions as provided by a next generation cinema system, such as the Dolby Atmos™ system. The channel-based audio is processed as standard or legacy channel-based format 704 information. In a legacy environment, the channel information is sent to a channel-based decoder 706 for playback through speaker feed outputs in a standard surround-sound environment, such as a 5.1 or 7.1 system. Any extra information provided by the spatial audio processor 702 with respect to playback of audio objects through speakers that are not present in the legacy surround environment is mixed down and collapsed for playback through existing speakers, or is disregarded and not used. In a next generation environment, the channel information may also be sent to a spatial (or adaptive) audio decoder 708 for playback in a next generation environment with multiple speakers in addition to the standard surround configuration, such as additional height speakers. In this case, the extra information provided by the spatial audio processor 702 with respect to playback of audio objects through speakers is recovered so that the spatial information can be used in the next generation environment. As shown in FIG. 7A, the spatial audio processor 702 generates certain metadata 710 that is incorporated into the channel-based format 704 and provided to the spatial audio decoder to be processed and utilized as part of the speaker feed output.

The spatial audio decoder 708 directly renders the next generation spatial audio format along with legacy channel based formats supports speaker configurations with more height channels than the front stereo pair of the legacy 7.1 format. FIG. 1 depicts a preferred configuration for this enhanced decoder containing four height speakers, two in front of the listener and two behind. As such, this configuration is able to accurately render position and motion of height objects within the entire height plane. The metadata 710 inserted in the legacy 7.1 channel-based format 704 may therefore be used by the spatial audio decoder 708 to distribute the two front height channels across this potentially larger set of height speakers in order to better approximate the original intent of objects in the height plane.

Figure 7B:
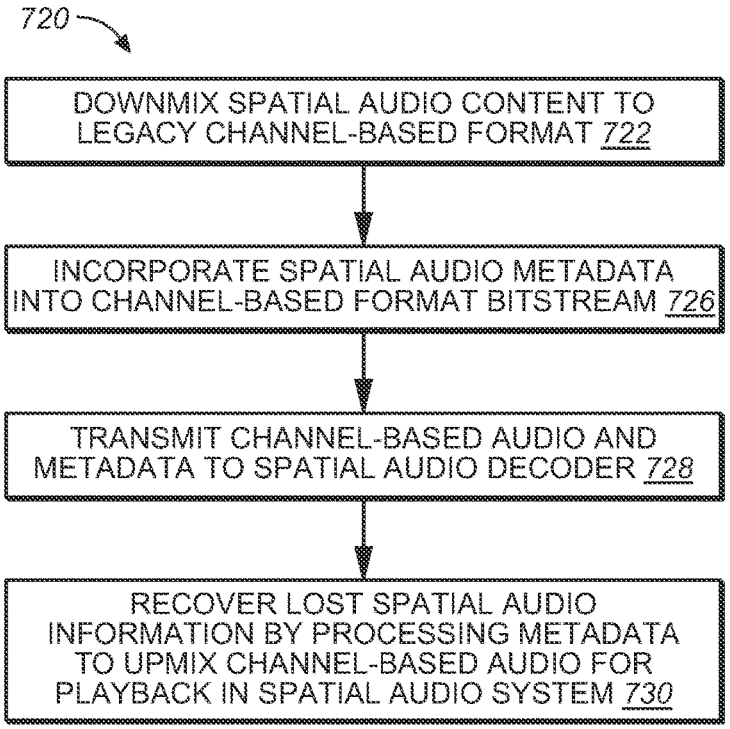
FIG. 7B is a flowchart that illustrates process steps in a method of rendering and playback of spatial audio content using a channel-based format, under an embodiment.

In an embodiment, any spatial audio format information that may have been lost by the rendering of spatial audio to the channel-based format is recovered through the use of metadata injected into the channel-based audio stream 704 and processed by spatial audio decoder 708. FIG. 7B is a flowchart that illustrates process steps in a method of rendering and playback of spatial audio content using a channel-based format, under an embodiment. As shown in flow diagram 720, spatial audio content that is played back through legacy channel-based equipment is transformed (down-mixed) into the appropriate channel-based format (e.g., 5.1 or 7.1, etc.), block 722. This means that certain of the positional information within the audio objects and positional metadata comprising the spatial audio content is lost or collapsed as the number of playback channels and/or processing power of the channel-based decoders is insufficient to process playback this information. To retain this information for use in spatial audio equipment even after the audio content is rendered as channel-based audio, certain metadata generated by the spatial audio processor is injected or incorporated into the channel-based data, block 726. The channel-based audio can then be sent to a channel-based audio decoder or a spatial audio decoder. For the embodiment of FIG. 7B, the channel-based audio data is transmitted along with the metadata to a spatial audio decoder, block 728. The spatial audio decoder processes the metadata to recover at least some of the positional information that was lost during the downmix operation of block 722. This process essentially upmixes the channel-based audio content back to the spatial audio content for playback in a spatial audio environment, block 730. The recovered and upmixed audio content may or may not match the content that would be generated if the spatial audio processor fed spatial audio content directly to the spatial audio decoder, but in general, a majority of the positional content lost during the downmix to the channel-based audio format can be recovered.

Figures 8, 9:
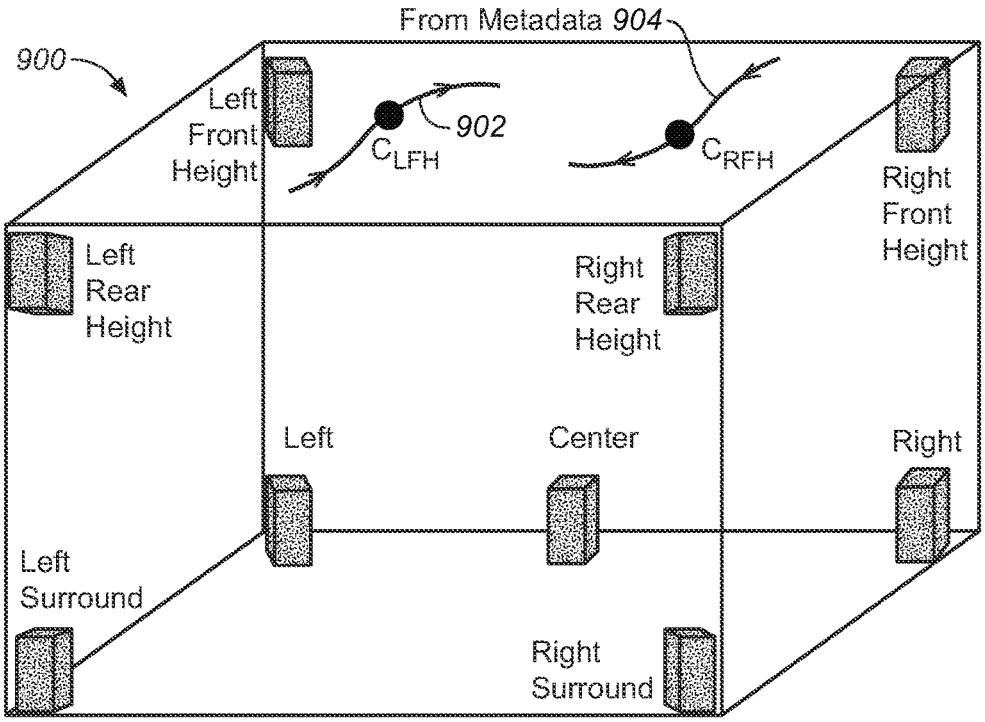
FIG. 8 is a table illustrating certain metadata definitions and parameters, under an embodiment.
FIG. 9 illustrates the reproduction of audio object sounds using metadata in a 9.1 surround system, under an embodiment.

As shown in FIGS. 7A and 7B, certain metadata generated by the spatial audio processor is used to recover positional information for audio objects that are lost during any downmixing from the original spatial audio format to the channel-based format. FIG. 8 is a table illustrating certain definitions and parameters for metadata used to recover spatial information, under an embodiment. As shown in FIG. 8, example metadata definitions include inflection point information, height channel trajectory information, and direct up-mix and down-mix information.

Various methods may be used to generate and apply the metadata 710 for the purpose of processing spatial audio content for incorporation into channel-based audio for playback in spatial audio systems, and reference will be made to several specific methods.

Inflection Point

Figure 4D:
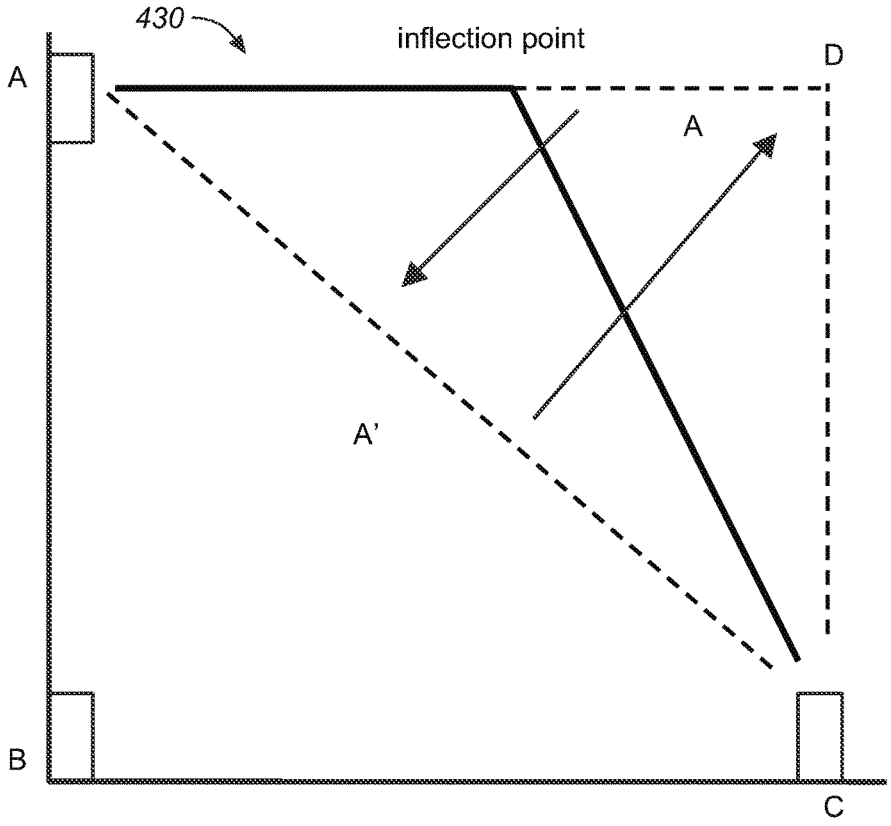
FIG. 4D illustrates the use of an inflection point in metadata to up-mix channel-based audio for use in a spatial audio system, under an embodiment.

One type of rendering metadata is based on the inflection point. As previously discussed, the use of an inflection point will collapse any element located between the front height speakers and the inflection point, and stretch points located between the inflection point and the rear speakers. FIG. 4D illustrates the use of an inflection point in metadata to up-mix channel-based audio for use in a spatial audio system, in accordance with an embodiment. Diagram 430 illustrates the collapse and stretch of points along axis A behind the inflection point relative to diagonal axis A' in relation to the inflection point. Carrying the inflection point coordinates allows the spatial audio decoder to essentially up-mix the channel-based audio to intelligently recreate rear height channels by reversing A' into A, and partially reconstruct the original sound locations between the inflection point and the rear height speakers.

Although embodiments have been described with reference to the use of a single inflection point, it should be noted that two or more inflection points may be defined, depending upon the requirements and constraints of the application and playback environment.

Generating Trajectories for the Height Channels

One method for distributing the stereo front height channels through the height plane is informed by the manner in which these height channels are constructed from objects by the spatial audio rendering process. Each of these height channel signals is computed as the weighted sum of a multitude of audio objects, where each of these objects has a time-varying trajectory in the height plane. During this rendering process, the speaker position associated with these two height channels is assumed to be static. However, given this construction, a more accurate representation of the average position of the overall audio contributing to each channel may be computed as a weighted sum of the time-varying positions of the contributing objects. The result is a time-varying trajectory for each of the two channels in the height plane. These two time-varying trajectories may then be inserted as metadata into the legacy 7.1 content. In an enhanced decoder, these trajectories may be used to move the signals contained in the stereo front height channels through a larger speaker array in the height plane as depicted in FIG. 9. FIG. 9 illustrates the reproduction of audio object sounds using metadata in a 9.1 surround system, under an embodiment. As shown in diagram 900, object $C_{LFH}$ moves along path 902 and object $C_{RFH}$ moves along path 904.

One specific method for computing these trajectories is as follows. Let $C_{LFH}$ and $C_{RFH}$ represent the signals in the left front and right front height channels, and let $O_1 \ldots O_N$ represent the signals of the N audio objects from which these two channel signals are generated by the spatial rendering process. Associated with each audio object $O_i$ is a time varying trajectory $(x_i, y_i)$ in the height plane. The channel signals may be computed from the object signals according to the mixing equation:

$$\begin{bmatrix} C_{LFH} \\ C_{RFH} \end{bmatrix} = \begin{bmatrix} \alpha_1 & \ldots & \alpha_N \\ \beta_1 & \ldots & \beta_N \end{bmatrix} \begin{bmatrix} O_1 \\ \vdots \\ O_N \end{bmatrix}$$

In the above equation, $\alpha_i$ and $\beta_i$ are the mixing coefficients corresponding to $C_{LFH}$ and $C_{RFH}$, respectively. These mixing coefficients may be computed by the spatial audio renderer as a function of the trajectories $(x_i, y_i)$ relative to the assumed speaker positions of the two channels in the height plane. Given this equation for the generation of the channel signals, an average trajectory for each of the two channels, $(x_{LFH}, y_{LFH})$ and $(x_{RFH}, y_{RFH})$, may be computed as a weighted sum of the object trajectories $(x_i, y_i)$:

$$\begin{bmatrix} x_{LFH} & y_{LFH} \\ x_{RFH} & y_{RFH} \end{bmatrix} = \begin{bmatrix} \frac{1}{\sum_{i=1}^{N} \alpha_i L(O_i)} & 0 \\ 0 & \frac{1}{\sum_{i=1}^{N} \beta_i L(O_i)} \end{bmatrix} \begin{bmatrix} \alpha_1 L(O_1) & \ldots & \alpha_N L(O_N) \\ \beta_1 L(O_1) & \ldots & \beta_N L(O_N) \end{bmatrix} \begin{bmatrix} x_1 & y_1 \\ \vdots & \vdots \\ x_N & y_N \end{bmatrix}$$

In the above equation, the weights are a function of the mixing coefficients $\alpha_i$ and $\beta_i$ along with a loudness measure $L(O_i)$ of each object. This loudness measure may be the RMS (root mean square) level of the signal computed over some short-time interval or some other measure generated from a more advanced model of loudness perception. By including this loudness measure, the trajectories of objects that are louder contribute more to the average trajectory computed for each channel. Once computed, the trajectories $(x_{LFH}, y_{LFH})$ and $(x_{RFH}, y_{RFH})$ may be inserted into the legacy 7.1 format as metadata. In an enhanced decoder, this metadata may be extracted and used to distribute the channel signals $C_{LFH}$ and $C_{RFH}$ across a larger speaker array in the height plane. This may be achieved by treating the signals $C_{LFH}$ and $C_{RFH}$ as audio objects and using the same spatial renderer which generated these signals to render the objects across the speaker array as a function of the trajectories $(x_{LFH}, y_{LFH})$ and $(x_{RFH}, y_{RFH})$.

Directly Mixing the Height Channels to a Larger Set of Channels

Rather than computing trajectories for each of the front height channels, an alternative method involves computing metadata, which up-mixes the front height channels directly to a larger set of channels in the height plane. For example, the configuration depicted in FIG. 2 containing four height channels may be chosen. If this larger set contains M channels labeled $C_1 \ldots C_M$, then the up-mixing may be represented by the following equation:

$$\begin{bmatrix} C_1 \\ \vdots \\ C_M \end{bmatrix} = M \begin{bmatrix} C_{LFH} \\ C_{RFH} \end{bmatrix}$$

In the above equation, M is a time-varying M×2 up-mixing matrix. This matrix M may be inserted into the legacy 7.1 format as metadata along with data specifying the number and assumed position of the channels $C_1 \ldots C_M$, both of which may also be time varying. In an enhanced decoder, the matrix M may be applied to $C_{LFH}$ and $C_{RFH}$ to generate the signals $C_1 \ldots C_M$. If the enhanced decoder is rendering to speakers in the height plane whose numbers and positions match those specified in the metadata, then the signals $C_1 \ldots C_M$ may be sent to those speakers directly. If, however, the number and position of speakers in the height plane is different from that specified in the metadata, then the renderer must remap the channel signals $C_1 \ldots C_M$ to the actual speaker array. This may be achieved by treating each signal $C_1 \ldots C_M$ as an audio object with a position equal to that specified in the corresponding metadata. The spatial renderer may then use its object-rendering algorithm to pan each of these objects to the appropriate physical speakers.

The up-mixing matrix M may be chosen to make the resulting signals $C_1 \ldots C_M$ as close as possible to some desired reference signals $R_1 \ldots R_M$. These reference signals may be generated by defining speakers in the height plane located at the same positions as those associated with $C_1 \ldots C_M$. The spatial rendering may then start with the same N objects used to generate $C_{LFH}$ and $C_{RFH}$ but now render them directly to these M speaker locations:

$$\begin{bmatrix} R_1 \\ \vdots \\ R_M \end{bmatrix} = P \begin{bmatrix} O_1 \\ \vdots \\ O_N \end{bmatrix}$$

In the above equation, P is a mixing matrix containing mixing coefficients computed by the spatial renderer as a function of the object trajectories with respect to the M speaker locations associated with $C_1 \ldots C_M$. In other words, $R_1 \ldots R_M$ is the optimal rendering of the N objects given the M speaker locations. Since $C_1 \ldots C_M$ are computed as an up-mix of the two height channels through matrix M, the signals $C_1 \ldots C_M$ can in general only approximate $R_1 \ldots R_M$ assuming M>2.

The optimal up-mixing matrix $M_{opt}$ may be chosen to minimize a cost function, F( ), which takes as its inputs the signals $C_1 \ldots C_M$ and the reference signals $R_1 \ldots R_M$:

$$M_{opt} = \min_{M}\left\{F\left(M\begin{bmatrix} C_{LFH} \\ C_{RFH} \end{bmatrix}, \begin{bmatrix} R_1 \\ \vdots \\ R_M \end{bmatrix}\right)\right\}$$

In other words, $M_{opt}$ is chosen to make $C_1 \ldots C_M$ as close as possible to $R_1 \ldots R_M$, where "closeness" is defined by the cost function F( ). Many possible cost functions exist. A computationally straightforward approach utilizes the mean square error between the samples of the digital signals $C_1 \ldots C_M$ and $R_1 \ldots R_M$. In this case a closed form solution for $M_{opt}$ exists, computed as a function of the signals $C_{LFH}$, $C_{RFH}$, and $R_1 \ldots R_M$. More complex possibilities for the cost function exist as well. For example, one may minimize a difference between some perceptual representation, such as specific loudness, of $C_1 \ldots C_M$ and $R_1 \ldots R_M$. Yet another option is to infer positions of each of the original N objects based on the object mixing coefficients and positions of $C_1 \ldots C_M$ and $R_1 \ldots R_M$. One may define a cost function as a sum of weighted distances between object positions inferred from $C_1 \ldots C_M$ and those inferred from $R_1 \ldots R_M$, where the weighting is given by the loudness of the objects $L(O_i)$. For these more complex cases, a closed form solution for $M_{opt}$ may not exist in which case an iterative optimization technique, such as gradient descent, may be employed.

Using the Matrix M as Down-mix Metadata in Legacy Formats

Some legacy channel-based audio formats contain metadata for down-mixing channels when the presentation speaker format contains fewer speakers than channels. For example, if a 7.1 signal with stereo height is played back over a system with only 5.1 speakers on the floor, then the stereo height channels must be down-mixed to the floor channels before playback over the speakers. As a default configuration, these left and right height channels may be statically down-mixed into the front left and right floor speakers. In this case the down-mix suffers from the same loss of forward and backward motion of height objects incurred when rendering to the 7.1 format. However some legacy channel-based formats, such as Dolby TrueHD™, allow for dynamic time-varying down-mix metadata. In this case, the down-mix of the stereo height channels into the floor channels may be represented by the equation $$\begin{bmatrix} D_L \\ D_C \\ D_R \\ D_{Ls} \\ D_{Rs} \end{bmatrix} = D\begin{bmatrix} C_{LFH} \\ C_{RFH} \end{bmatrix} + \begin{bmatrix} C_L \\ C_C \\ C_R \\ C_{Ls} \\ C_{Rs} \end{bmatrix}$$

In the above equation, D is a general time-varying 5×2 down-mix matrix. One may note the similarity of down-mix matrix D with the up-mixing matrix M described above for distributing the height channels across the height plane. In fact, the matrix M from above may be simultaneously used for both down-mixing and its originally stated purpose. In this case, the number N may be set to 5 and the (x,y) positions associated with the channels $C_1 \ldots C_5$ equal to the assumed (x,y) position of the L, C, R, Ls, and Rs channels. With this construction, the resulting matrix M may serve as an appropriate down-mix matrix D for the height channels. When applied for down-mixing in a legacy decoder, forward and backward movement of the height objects is restored in the floor plane. This same movement is restored in the height plane when used in an enhanced decoder for its original purpose. Since the matrix M is stored in an already specified down-mix metadata field, no additional metadata is required. One may add a flag, however, to indicate that the stored down-mix matrix is also intended for alternate use in an enhanced decoder. Such a flag may be provided as a metadata element in addition to the down-mix matrix, D.

Metadata Definition and Transmission Format

In an embodiment, the spatial audio processor 702 of FIG. 7A includes an audio codec that comprises an audio encoding, distribution, and decoding system that is configured to generate a bitstream containing both conventional channel-based audio elements and audio object coding elements. The audio coding system is built around a channel-based encoding system that is configured to generate a bitstream that is simultaneously compatible with a first decoder configured to decode audio data encoded in accordance with a first encoding protocol (e.g., channel-based decoder 706) and a secondary decoder configured to decode audio data encoded in accordance with a secondary encoding protocols (e.g., spatial object-based decoder 708). The bitstream can include both encoded data (in the form of data bursts) decodable by the first decoder (and ignored by any second decoder) and encoded data (e.g., other bursts of data) decodable by the second decoder (and ignored by the first decoder).

Bitstream elements associated with a secondary encoding protocol also carry and convey information (metadata) characteristics of the underlying audio, which may include, but are not limited to, desired sound source position, velocity, and size. This base metadata set is utilized during the decoding and rendering processes to re-create the proper (i.e., original) position for the associated audio object carried within the applicable bitstream. The base metadata is generated during the creation stage to encode certain positional information for the audio objects and to accompany an audio program to aid in rendering the audio program, and in particular, to describe the audio program in a way that enables rendering the audio program on a wide variety of playback equipment and playback environments. An important feature of the adaptive audio format enabled by the base metadata is the ability to control how the audio will translate to playback systems and environments that differ from the mix environment. In particular, a given cinema may have lesser capabilities than the mix environment.

In an embodiment, a base set of metadata controls or dictates different aspects of the adaptive audio content and is organized based on different types including: program metadata, audio metadata, and rendering metadata (for channel and object). Each type of metadata includes one or more metadata items that provide values for characteristics that are referenced by an identifier (ID). A second set of metadata 710 provides the means for recovering any spatial information lost during channel-based rendering of the spatial audio data. In an embodiment, the metadata 710 corresponds to at least one of the metadata types illustrated in table 800 of FIG. 8. The metadata 710 may be generated and stored as one or more files that are associated or indexed with corresponding audio content so that audio streams are processed by the adaptive audio system interpreting the metadata generated by the mixer. In an embodiment, the metadata may be formatted in accordance with a known coding method. One such method is described in International Patent Publication No. WO2000/60746, published 12 Oct. 2000, which is hereby incorporated by reference.

Aspects of the audio environment of described herein represents the playback of the audio or audio/visual content through appropriate speakers and playback devices, and may represent any environment in which a listener is experiencing playback of the captured content, such as a cinema, concert hall, outdoor theater, a home or room, listening booth, car, game console, headphone or headset system, public address (PA) system, or any other playback environment. Although embodiments have been described with respect to examples and implementations in a cinema environment in which the spatial audio content is associated with film content for use in digital cinema processing systems, it should be noted that embodiments may also be implemented in non-cinema environments. The spatial audio content comprising object-based audio and channel-based audio may be used in conjunction with any related content (associated audio, video, graphic, etc.), or it may constitute standalone audio content. The playback environment may be any appropriate listening environment from headphones or near field monitors to small or large rooms, cars, open air arenas, concert halls, and so on.

Aspects of the system 100 may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof. In an embodiment in which the network comprises the Internet, one or more machines may be configured to access the Internet through web browser programs.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of recovering spatial audio information rendered into a channel-based format for playback in a first spatial audio environment, the channel-based format comprising a surround-sound format which includes a plurality of height channels, the first spatial audio environment including a plurality of height speakers and a plurality of additional height speakers, the method comprising:

deriving metadata defining positional information of audio elements in a spatial audio processor that generates both channel-based and object-based information of the audio elements, wherein the metadata includes a matrix suitable for up-mixing a first set of channels to a second set of channels for playback by the plurality of height speakers and the plurality of additional height speakers in the first spatial audio environment, wherein the first set of channels comprises the plurality of height channels and the second set of channels comprises the plurality of height channels and the a plurality of additional height channels, and wherein the matrix is also suitable for down-mixing the first set of channels to a third set of channels for playback in a second spatial audio environment, wherein the second spatial audio environment includes no height speakers;

incorporating the metadata in a channel-based format;

combining the metadata and channel-based information in a spatial audio decoder to facilitate playback of the audio elements in the first spatial audio environment; and wherein the up-mixing matrix comprises a time-varying matrix of size M×2, and wherein the matrix is incorporated into the channel-based format with data specifying the number M corresponding to a total number of height channels of the second set of channels, and an assumed position of the M height channels.

2. The method of claim 1 wherein the channel-based format comprises a 7.1 surround-sound format.

3. The method of claim 1, wherein the audio elements comprise audio objects that are transmitted to respective speakers whose positions correspond to those specified in the metadata.

4. The method of claim 1 wherein the up-mixing matrix is selected to minimize a defined cost function that is defined relative to a plurality of reference signals.

5. The method of claim 1 wherein the metadata supplements a first metadata set that includes metadata elements associated with an object-based stream of the spatial audio information, the metadata elements for each object-based stream specifying spatial parameters controlling the playback of a corresponding object-based sound, and comprising one or more of:

sound position, sound width, and sound velocity; and further wherein the first metadata set includes metadata elements associated with a channel-based stream of the spatial audio information, and wherein the metadata elements associated with each channel-based stream comprises designations of surround-sound channels of the speakers in a speaker array in accordance with a defined surround-sound configuration.

6. The method of claim 5 wherein the first metadata set includes metadata to enable upmixing or downmixing of at least one of the channel-based audio streams and the object-based audio streams in accordance with a change from a first configuration of the speaker array to a second configuration of the speaker array.

7. The method of claim 6 wherein the speakers of the speaker array are placed at specific positions within the playback environment, and wherein metadata elements associated with each respective object-based stream specify that one or more sound components are rendered to a speaker feed for playback through a speaker nearest an intended playback location of the sound component, as indicated by the position metadata.

8. The method of claim 1 further comprising computing a plurality of height channel signals as a weighted sum of a corresponding plurality of audio objects defined by the spatial audio information.

9. The method of claim 8 wherein the positions associated with the plurality of height channels are static.

10. The method of claim 8 wherein the height channels are dynamic and the audio objects have a time-varying trajectory in a height plane.

11. The method of claim 10 further comprising deriving mixing coefficients corresponding to right and left front speaker heights, respectively as a function of trajectories relative to assumed speaker positions of two channels in the height plane.

12. The method of claim 11 further comprising deriving a weighted sum of the object trajectories, wherein the weights are a function of the mixing coefficients along with a loudness measure of each audio object.

13. The method of claim 12 further comprising defining the metadata elements using the mixing coefficients and weighted sum of the object trajectories.

14. The method of claim 1 further comprising identifying an inflection point along a front height axis to define a panning point at which sound is switched to or from front height speakers to rear surround speakers.

15. The method of claim 14 wherein any sound element located between the front height speakers and the inflection point will be collapsed to the front height speakers, and any sound element located between the inflection point and the rear height speakers will be stretched between the front height speakers and the rear surround speakers.

16. The method of claim 15 wherein the metadata comprises elements defining a position of the inflection point.

17. The method of claim 16 wherein the position of the inflection point is expressed as coordinates of an enclosure defined within the first spatial audio environment.

18. An apparatus for recovering spatial audio information rendered into a channel-based format for playback in a first spatial audio environment, the channel-based format comprising a surround-sound format which includes a plurality of height channels, the first spatial audio environment including a plurality of height speakers and a plurality of additional height speakers, the apparatus comprising a processor configured to:

derive metadata defining positional information of audio elements in a spatial audio processor that generates both channel-based and object-based information of the audio elements, wherein the metadata includes a matrix suitable for up-mixing a first set of channels to a second set of channels for playback by the plurality of height speakers and the plurality of additional height speaker in the first spatial environment, wherein the first set of channels comprises the plurality of height channels and the second set of channels comprises the plurality of height channels and a plurality of additional height channels, and wherein the matrix is also suitable for down-mixing the first set of channels to a third set of channels for playback in a second spatial audio environment, wherein the second spatial audio environment includes no height speakers;

incorporate the metadata in a channel-based format;

combine the metadata and channel-based information in a spatial audio decoder to facilitate playback of the audio elements in the first spatial audio environment; and wherein the up-mixing matrix comprises a time-varying matrix of size M×2, and wherein the matrix is incorporated into the channel-based format with data specifying the number M corresponding to a total number of height channels of the second set of channels, and an assumed position of the M height channels.

19. A non-transitory storage medium recording a program of instructions that is executable by a device for performing a method of recovering spatial audio information rendered into a channel-based format for playback in a first spatial audio environment, the channel-based format comprising a surround-sound format which includes a plurality of height channels, the first spatial audio environment including a plurality of height speakers and a plurality of additional height speakers, the method comprising:

deriving metadata defining positional information of audio elements in a spatial audio processor that generates both channel-based and object-based information of the audio elements, wherein the metadata includes a matrix suitable for up-mixing a first set of channels to a second set of channels for playback by the plurality of height speakers and the plurality of additional height speakers in the first spatial audio environment, wherein the first set of channels comprises the plurality of height channels and the second set of channels comprises the plurality of height channels and a plurality of additional height channels, and wherein the matrix is also suitable for down-mixing the first set of channels to a third set of channels for playback in a second spatial audio environment, wherein the second spatial audio environment includes no height speakers;

incorporating the metadata in a channel-based format;

combining the metadata and channel-based information in a spatial audio decoder to facilitate playback of the audio elements in the first spatial audio environment; and wherein the up-mixing matrix comprises a time-varying matrix of size M×2, and wherein the matrix is incorporated into the channel-based format with data specifying the number M corresponding to a total number of height channels of the second set of channels, and an assumed position of the M height channels.

* * * * *